United States Patent [19]

Searle

[11] 3,970,787

[45] July 20, 1976

[54] AUDITORIUM SIMULATOR AND THE LIKE EMPLOYING DIFFERENT PINNA FILTERS FOR HEADPHONE LISTENING

[75] Inventor: Campbell L. Searle, Weston, Mass.

[73] Assignee: Massachusetts Institute of Technology, Cambridge, Mass.

[22] Filed: Feb. 11, 1974

[21] Appl. No.: 441,259

[52] U.S. Cl. ..... 179/1 AT; 179/1 G

[51] Int. Cl.[2] ..... H04R 5/04

[58] Field of Search ..... 179/1 G, 1 GP, 1 J, 179/1 D, 1 AT, 1 M

[56] References Cited

UNITED STATES PATENTS

| | | | |
|---|---|---|---|
| 2,493,638 | 1/1950 | Olson | 179/1 J |
| 2,768,237 | 10/1956 | Faulker | 179/1 G |
| 2,920,138 | 1/1960 | Fogel | 179/1 G |
| 3,046,337 | 7/1962 | Hornyak | 179/1 G |
| 3,088,997 | 5/1963 | Bauer | 179/1 G |
| 3,217,080 | 11/1965 | Clark | 179/1 J |
| 3,535,453 | 10/1970 | Veneklasen | 179/1 AT |

FOREIGN PATENTS OR APPLICATIONS

| | | | |
|---|---|---|---|
| 989,642 | 9/1951 | France | 179/1 G |
| 1,134,416 | 2/1961 | Germany | 179/1 G |

OTHER PUBLICATIONS

"On the Diffraction of a Progressive Sound Wave by the Human Head," F. M. Wiener, Journal of Acoustical Soc. of Amer., vol. 19, No. 1, Jan. 1947, pp. 143–146.

"Stereophonic Earphones and Binaural Loudspeakers," B. B. Bauer, Journal of Audio Engineering Soc., vol. 9, No. 2, pp. 148–151, Apr. 1961.

*Primary Examiner*—George G. Stellar
*Attorney, Agent, or Firm*—Arthur A. Smith, Jr.; Robert Shaw; John N. Williams

[57] ABSTRACT

An auditorium simulator which is suitable for earphones or speakers placed closely to the ears, is comprised of delay and attenuation devices for simulating the various sound paths in an auditorium and includes listener simulating means for producing different direction-signifying transforms to the signals for the two ears, thus to give cues to the ears for localizing the direction of the signals in the respective simulated sound paths. Use of a number of these paths synthesizes the various important reflected images of the sound source, even of wide stage images, making possible a realistic high fidelity impression of concert hall attendance. Conventional two channel stereo recordings played from a conventional player or receiver are processed by an adapter for use by the simulator. The listener transforms are based upon interaural time delay between the ears of a listener, head shadow for the ear remote from the wall from which a reflection is supposed to be received and pinna effect. An alternative system for monaural processing to simulate the reflection paths to the listener with binaural processing to produce direction-signifying transforms is shown.

Systems are also shown dealing with inputs from widely spaced microphones, and more than two microphones to produce pseudo binaural direction-signifying signal streams.

Also, systems are described in which the simulator can modify the direction-signifying transforms to take into account head motion of the listener.

15 Claims, 35 Drawing Figures

10ℓ
12
10r
14
ℓ
r
120ms
80
40
30
20
10ms
-6.5 db
-6.5db
-5.0db
-2.8db
-2.1db
-1.6db
-1.6 db
-2.1db
-2.8db
-5.0db
-6.5db
-6.5 db
20
22
24
180°A
+63°A
500μ/S/-63°A
460μs/S/-58°A
+58°A
+45°A
18
360μs/S/-45°A
45°E 0°A
+35°A
270μs/S/-35°A
0°A
26
28
270μs/S/+35°A
-35°A
360μs/S/+45°A
-45°A
-58°A
460μs/S/+58°A
500μs/S/+63°A
-63°A
180°A
rIB
rIILR
ℓIIRL
rIIRL
ℓIILR
30
ℓIR
rIL
rIC
rIR
ℓIL
Er
32
Eℓ
ℓIC

AMPLITUDE, DB
FREQUENCY, KHz
0
10
20
30
40
5
15
25

AMPLITUDE, DB
FREQUENCY, KHz
PLASTER WALL
BRICK WALL
% ABSORBED
FREQUENCY, KHz

AUDITORIUM SIMULATOR AND THE LIKE EMPLOYING DIFFERENT PINNA FILTERS FOR HEADPHONE LISTENING

This invention concerns an electronic auditorium simulator or a similar simulating system for use with transducers that are closely positioned to the respective ears of a listener and introduce sound to the respective ears of the listener without substantial interaction of the actual pinna of the listener. The "pinna" is the largely cartilagenous projecting portion of the external ear. In this context the term "auditorium" refers to any place desired to be simulated, not only a concert hall, but a coffee house, etc.

Among the objects of the invention are to provide a system which is realistic in effect and operable in the home using conventional players, receivers, and earphones.

According to the invention there are provided in combination a delay means for producing delayed versions of the signal to simulate predetermined sound paths in an auditorium (i.e., long delays of the order of 10 to 100 milliseconds), means for altering the delayed versions in accordance with the character, e.g. length, of the sound paths to be simulated, and a listener simulating means for producing, from the delayed and altered versions, outputs for the left and right transducers in the form of different, direction-signifying transforms in accordance with the effect of the listener being disposed in the respective sound paths being simulated.

Preferably the listener simulating means filters the signal for pinna effect as well as head shadow, the filter characteristics simulating pinna response at the supposed angle of incidence upon the listener of the simulated path. In certain preferred embodiments the filter characteristics are established differently for the left and right transducers to simulate differences in left and right pinnas.

Also, circuits can be added to the headphones to sense head position, and this information can then be used to change the direction-signifying transforms in accordance with the head motion of the listener.

For simulating side wall reflections, preferably a short time delay (e.g. less than a millisecond) simulates interaural time differences due to difference in position of the listener's two ears along the sound path.

To simulate a sound image of substantial auditorium stage width, reflected from a side wall, each transducer preferably receives delayed versions from each side of the simulated stage, with large delays differing in accordance with differences in the lengths of the paths of the signals to the listener, and with small additional delay and head shadow filtering for the shaded ear. In a particular system for approximating this effect, the delayed versions which produce the image pass through an attenuator for decreasing its energy on the basis of path length, thence to a reflection filter means, thence branching to respective transducers via respective listener simulating means.

To simulate a narrow or point source image reflected from a side wall, each transducer receives an equally delayed version from the source, varying only by small delay and head shadow filtering appropriate to the shaded ear.

Where the recordings or broadcasts are based upon widely spaced pickups, preferably an adapter adapts the signal streams to a two channel binaural input by means of combining the signals with added delay and shadow effects commensurate with those experienced by a listener near the stage. This adapter is useful both alone, to simulate direct paths to the listener from a wide stage, and for providing inputs to reflection simulating paths.

Where there is a two channel stereo input, preferably there are separate delays for the respective channels and a summing circuit for each transducer receives the delayed versions of the signal and adds them to an undelayed version. Also, in preferred embodiments the means for altering the delayed versions in accordance with the character of the sound path being simulated comprises an attenuator based upon the length of the path and a reflection filter based upon loss due to frequency-selective absorption at the reflecting surface. Preferably, also, the delay means comprises a tapped delay line, and the simulator is set to simulate the combination of direct sound and first order reflection from the side and rear walls and ceiling, etc.

The invention comprehends the re-creation of the sound of a concert hall using only a standard two-channel record-playback medium. The sound of the hall, or any other room is re-created by simulating the dominant reflections in the hall and by feeding them to the listener in a listener-modified way so that he perceives each reflection to come from its proper direction in space. There are two aspects to this. First, as is generally known, a given reflection is simulated by feeding the sound signal through an appropriate time dealy to represent a path length longer than the direct sound and through an appropriate circuit to represent 1/R attenuation and if desired, frequency-selective absorption by the reflecting surface, i.e., walls or ceiling. Second, following this, by use of the listener simulating means, the angle of arrival of the reflection at the head is simulated, preferably by passing the signal through an appropriate time delay and filter means to represent the three most important components of auditory localization: interaural time delay, interaural amplitude differences because of head shadow, and pinna cues. By this means, an exceedingly realistic concert hall experience is made possible.

Certain embodiments of the invention will now be described in connection with the accompanying drawings, wherein.

Figure 2:
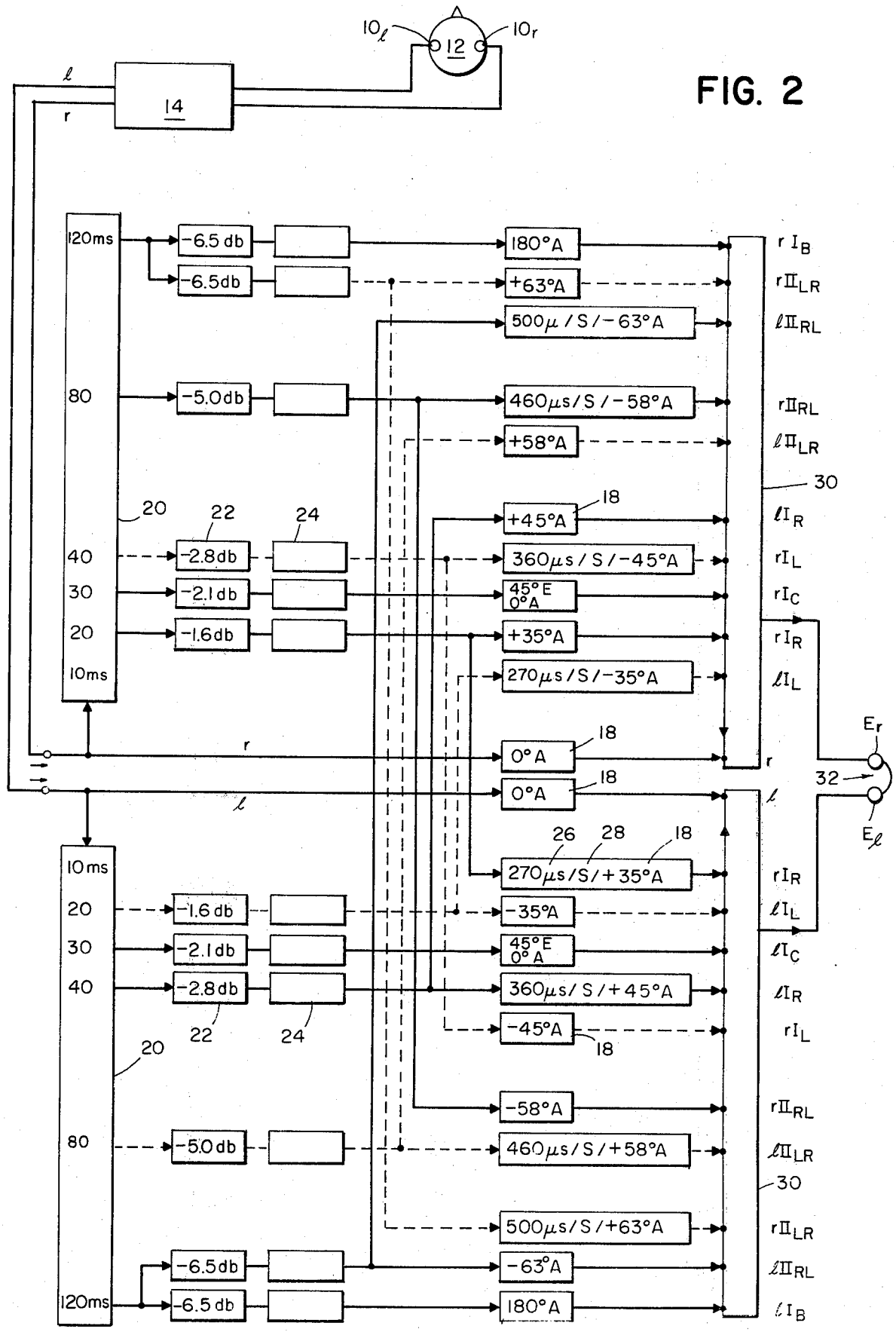
FIG. 2 is a block diagram of a first embodiment of the invention.
Figure 3:
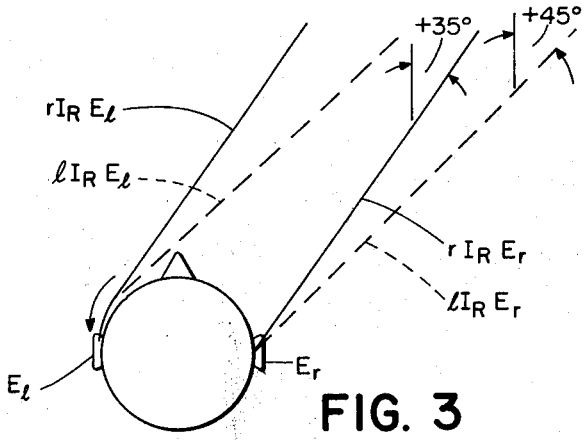
Figure 3A:
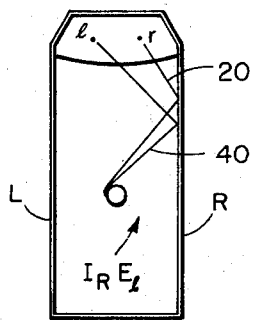
Figure 3B:
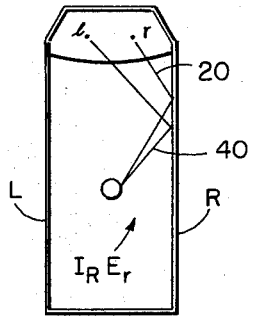
Figure 4:
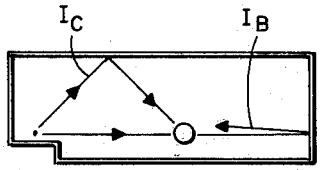
Figure 4B:
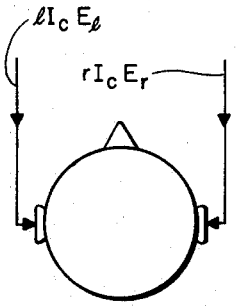
Figure 4A:
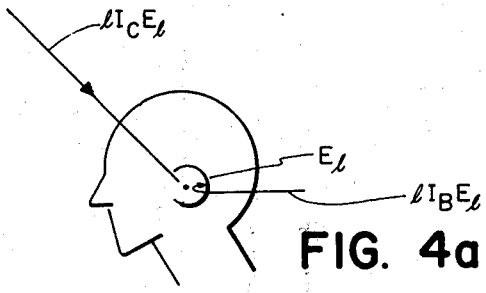
Figure 4C:
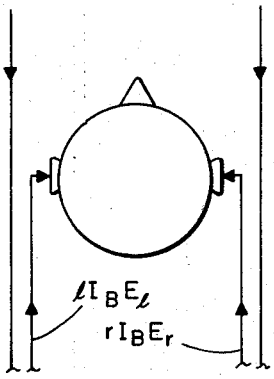

FIG. 2*a*–2*h* are graphs of head shadow-pinna effect response curves of a typical listener, for implementation by the circuitry of FIG. 2 while 2*i* illustrates sound-absorption characteristics of typical sound-reflective walls;

FIG. 3 is a plan diagrammatic view of the simulated effects of a 1st right wall reflected sound path upon a listener while FIGS. 3*a* and 3*b* trace through the auditorium the various sound paths of FIG. 3;

FIG. 4 is a side diagrammatic view of an auditorium illustrating 1st ceiling and back wall reflected sound paths while FIG. 4*a* is a side view for both back and ceiling reflections and FIGS. 4*b* and 4*c* are plan views illustrating ceiling and back wall reflections.

Figure 5:
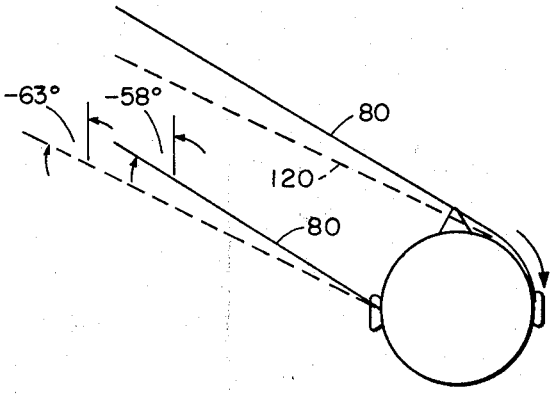
Figure 5A:
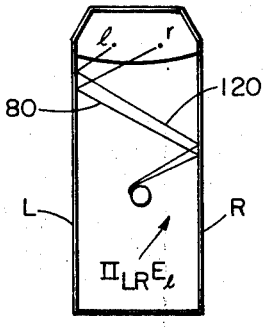
Figure 5B:
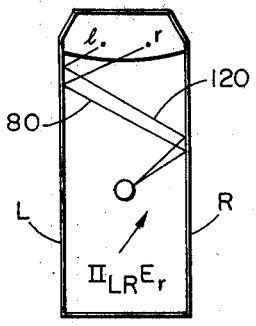

FIGS. 5–5*b* are views similar to FIGS. 3–3*b* illustrating 1st and 2nd order reflections.

Figure 6A:
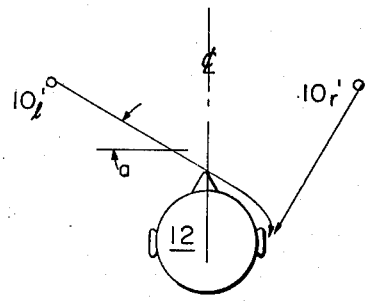
Figure 6:
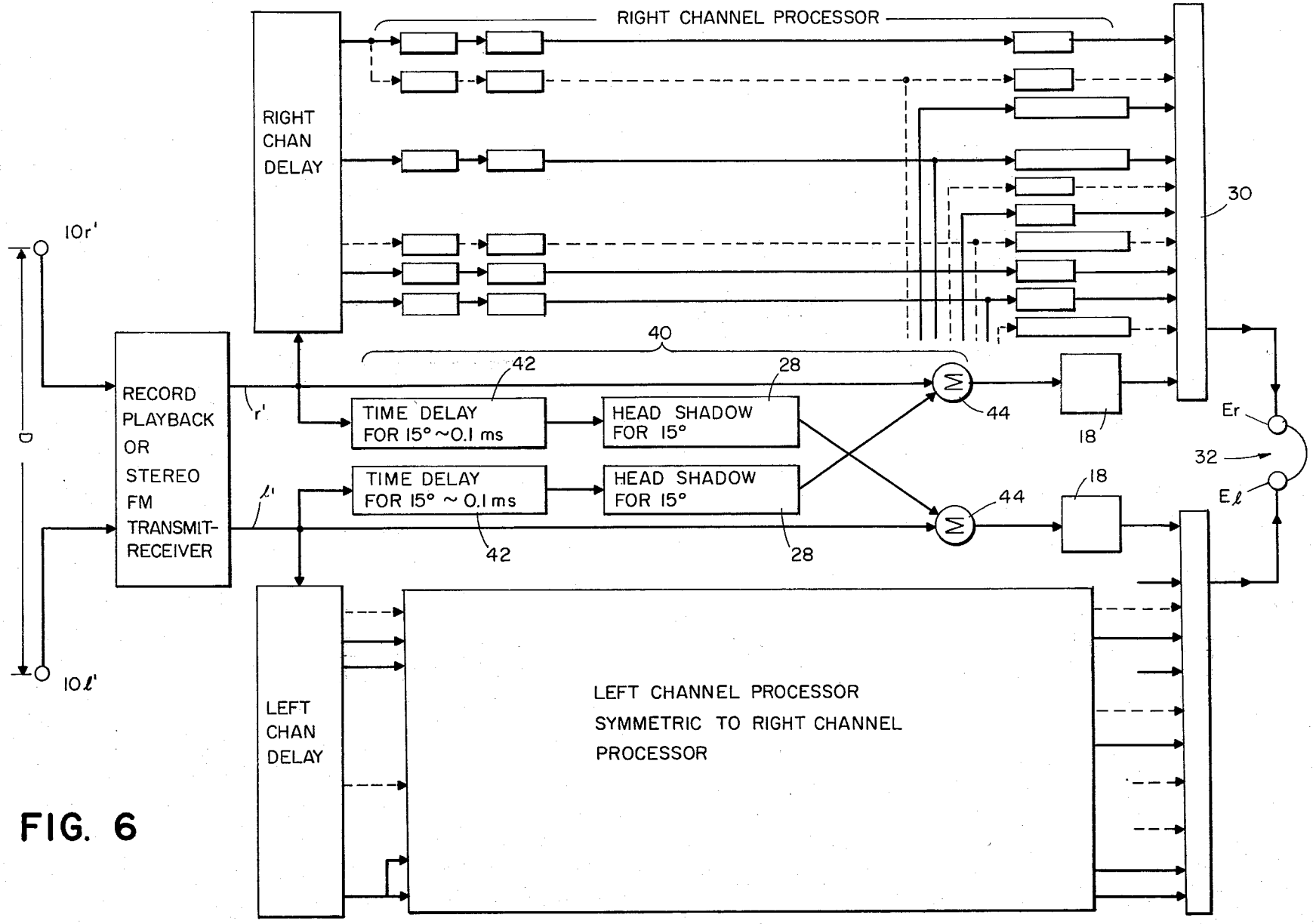
Figure 7:
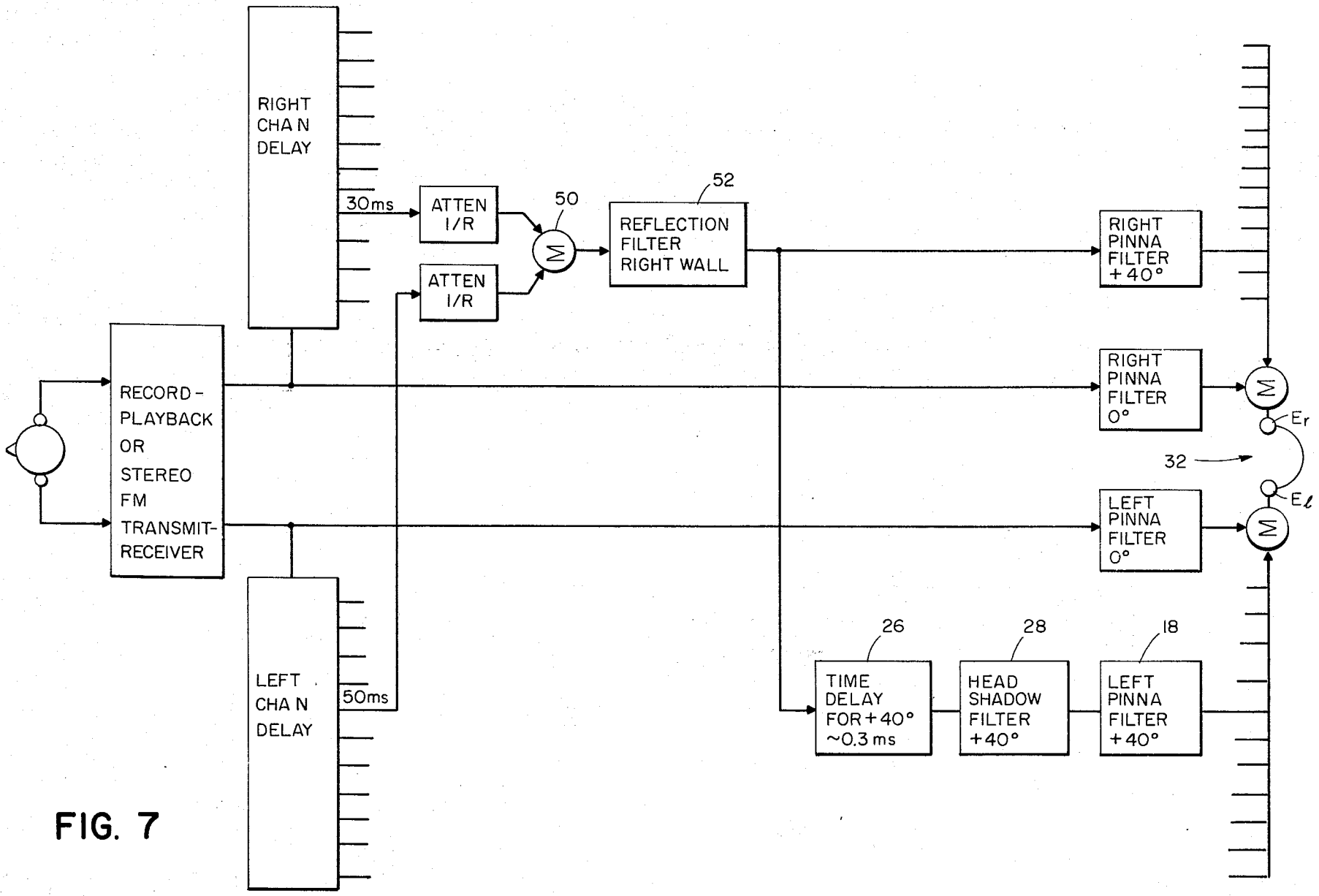
Figure 8:
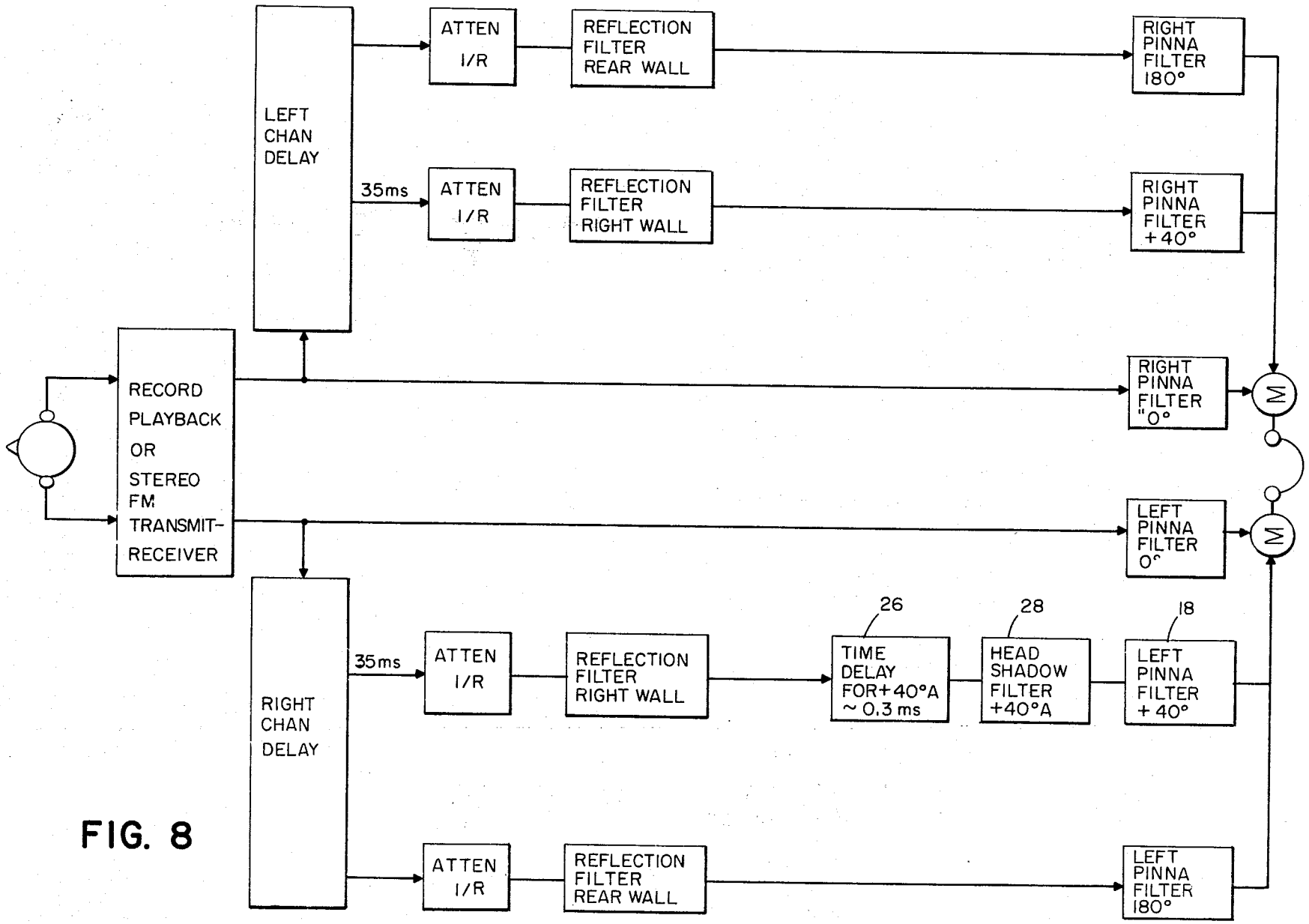
Figure 9:
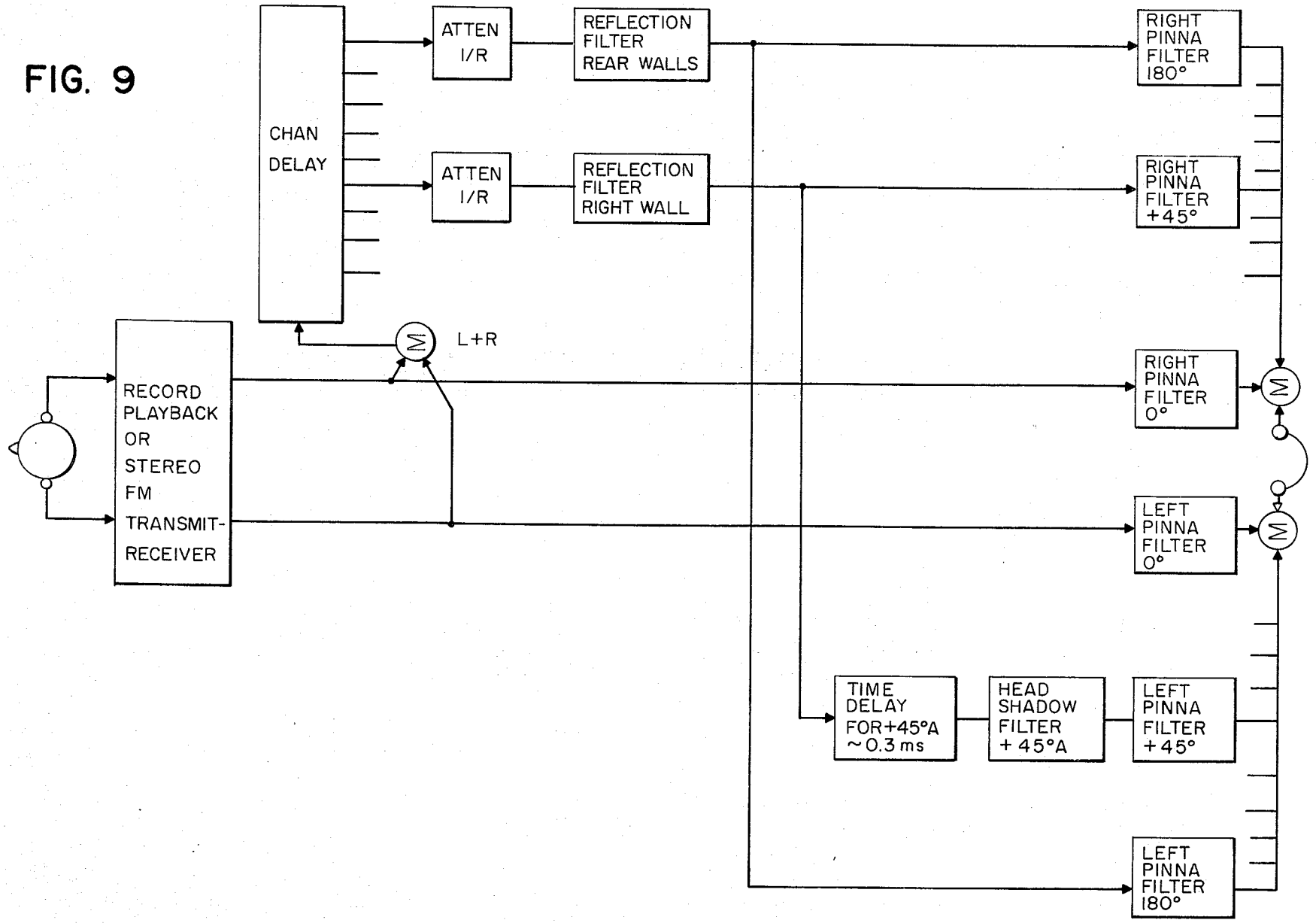
Figure 10:
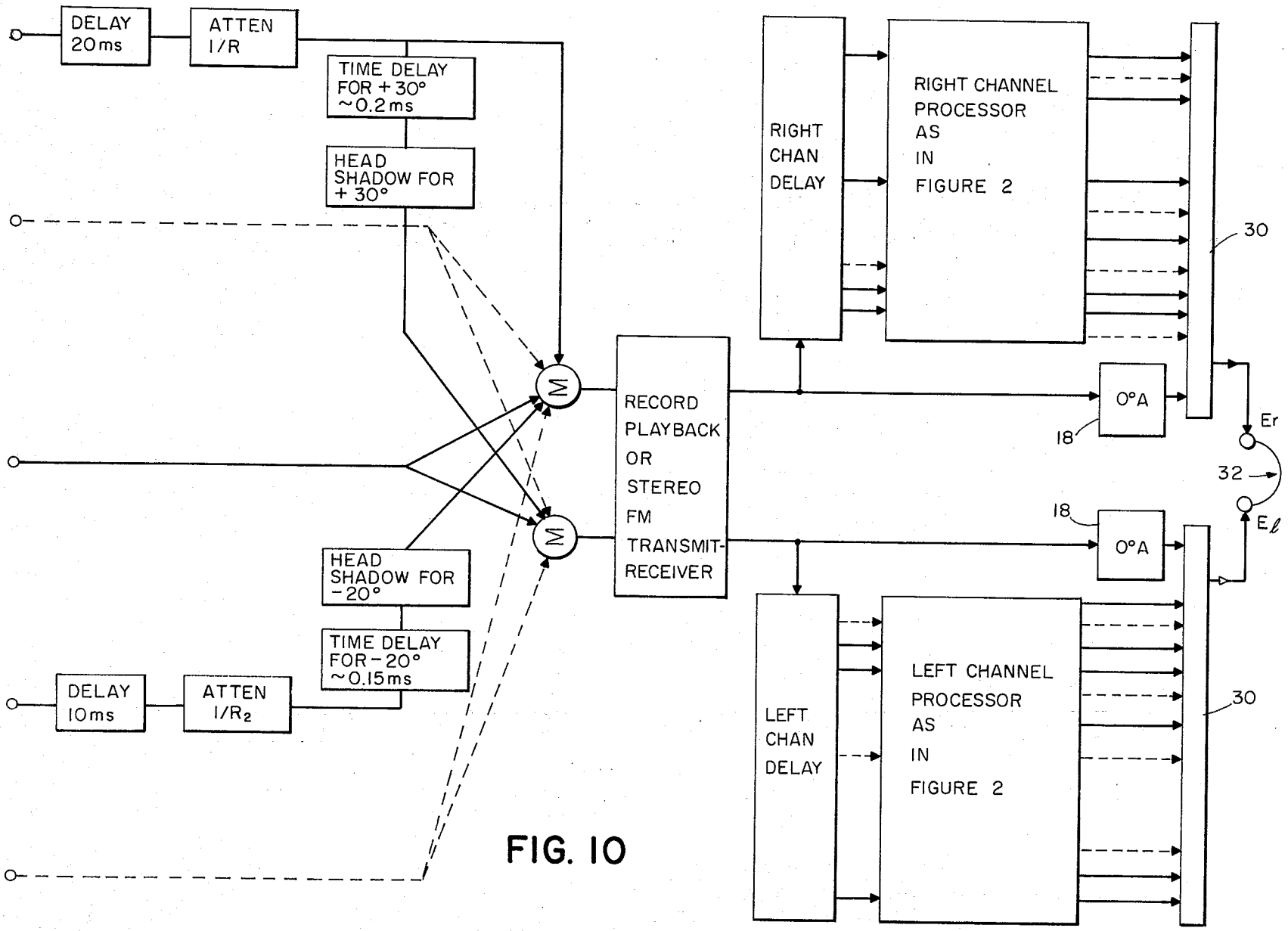
Figure 11:
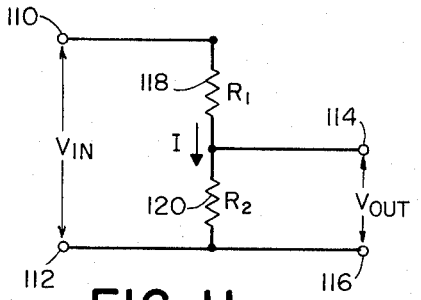
Figure 16:
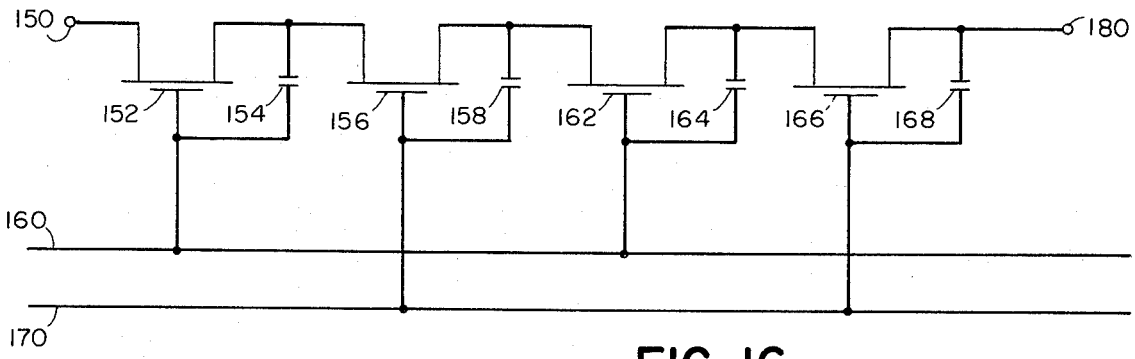
Figure 17:
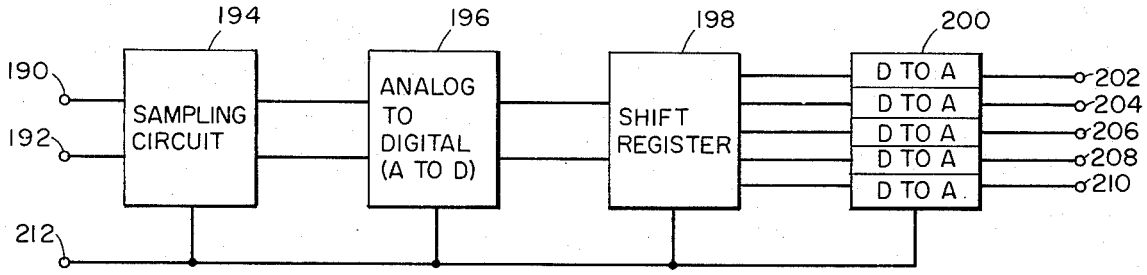

FIG. 6 is a block diagram similar to FIG. 2, but with parts broken away, illustrating an adapter permitting use of standard recordings which are recorded with wide spacing of microphones;

FIG. 6*a* is a diagram of a listener position simulated by the adapter of FIG. 6;

FIG. 7 is a view similar to FIG. 2 of another preferred embodiment in which simplifications are made by employing common reflection filters for sounds representing different parts of the same sound image;

FIG. 8 is a view similar to FIG. 2 of a preferred embodiment concerned with a point or small source of original sound;

FIG. 9 is a view similar to FIG. 2 of a preferred embodiment employing a monaural circuitry;

FIG. 10 is a view of apparatus similar to FIG. 6 dealing with more than two microphone pickups;

FIG. 11 is a circuit diagram of a resistive attenuator used to simulate 1/R attenuation;

FIGS. 12–15 are circuit diagrams of the elementary filter circuits out of which pinna effect filters and reflection filters are constructed;

FIG. 16 is a schematic diagram of a bucket-brigade delay line used for short-time delays (less than 1 millisecond);

FIG. 17 is a block diagram of an analog-to-digital/-digital-to-analog tapped delay line used for long-time delays (greater than 10 milliseconds).

Figure 18:
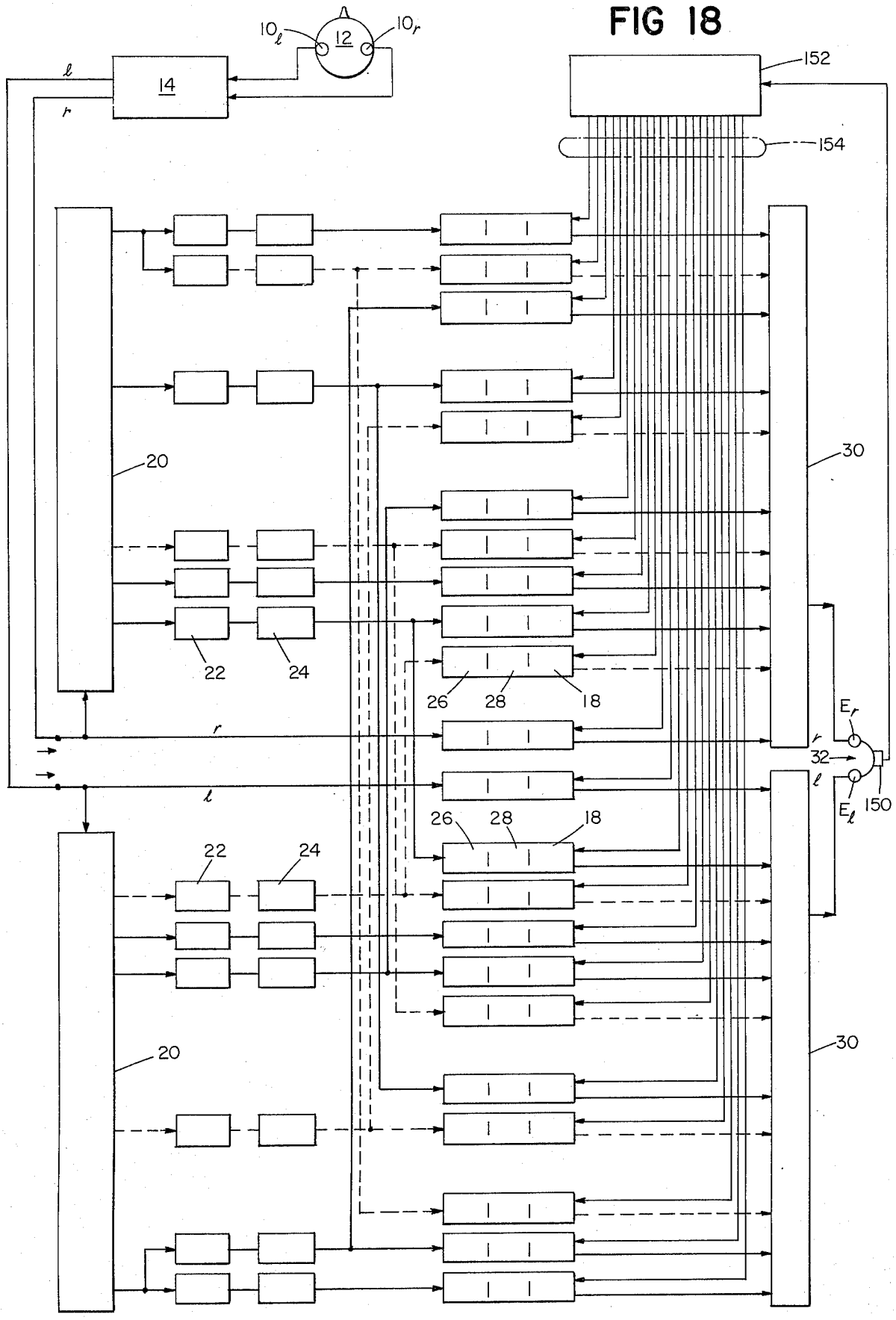

FIG. 18 is a block diagram of a system employing a headmotion detector for further simulating the concert hall experience.

Figure 1:
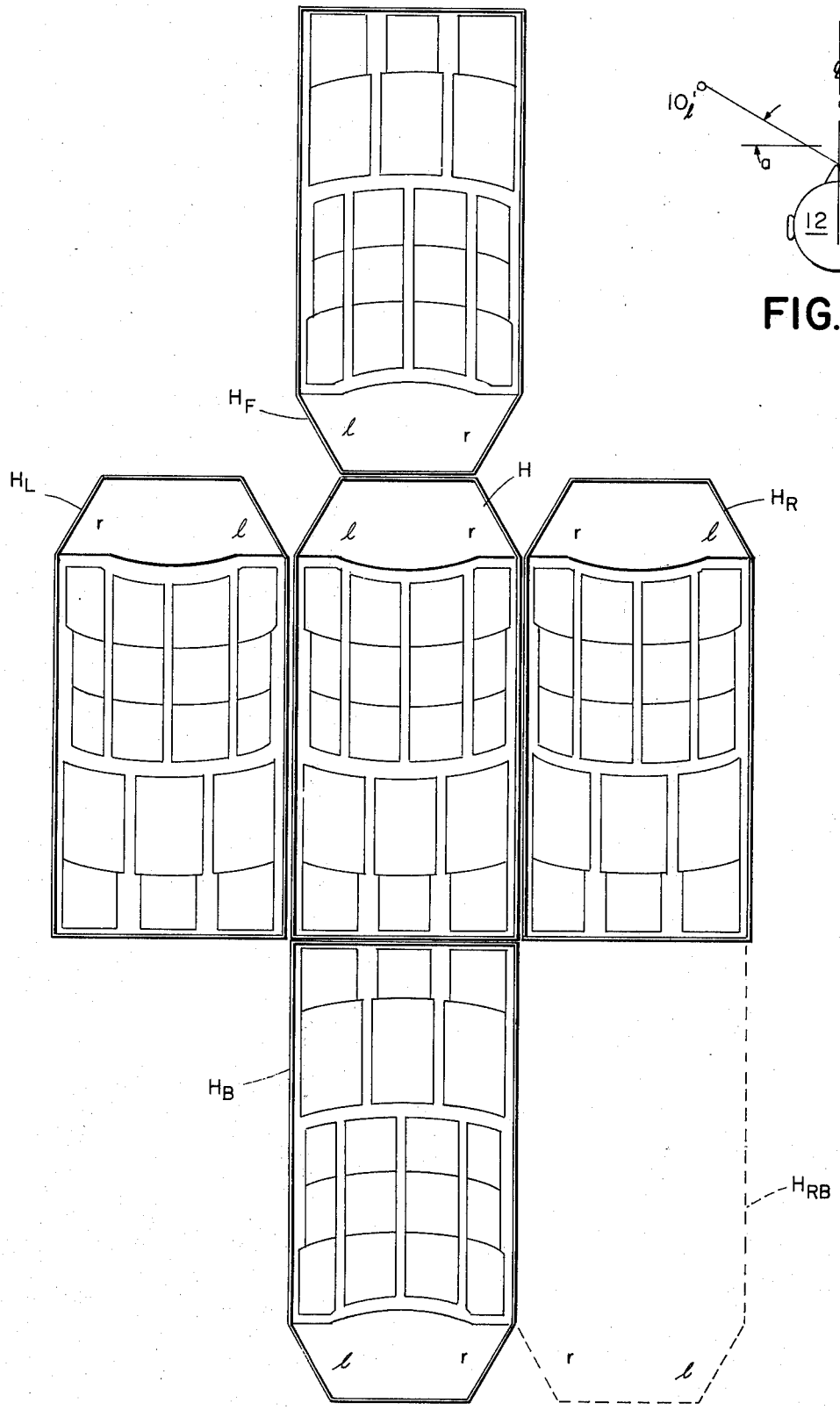
FIG. 1 is a plan view of an auditorium together with a representation of certain reflected sound images.

One simple way of visualizing the sound reflections in an actual concert hall is based on the fact that sound reflections obey similar laws to light reflections. Thus, imagine that the walls and ceiling of Symphony Hall were metalized and mirrow-like. Then a listener in the hall would see, from his vantage point, many Symphony Halls: some above him, some on either side, some in front, some behind, and some in the corners. The actual hall H and near images (ignoring the one from the ceiling for convenience of drawing) are shown in FIG. 1, i.e. $H_L$ (1st reflection left wall), $H_R$ (1st reflection right wall), $H_B$ (1st reflection back wall) and $H_F$ (1st reflection front wall). $H_{RB}$ 2nd reflection from right, then back wall is suggested by dashed lines.

Each of the reflections of sound from the orchestra can be represented as a "virtual image" of the "stage" part of the hall where the orchestra is. The simulators to be described enable the creation of sufficient of these virtual images to create a desired realistic effect.

These simulators have in common (1) two or more microphones to pick up the sound, (2) a stero (2 channel) record player or FM stereo receiver as the basic mechanism for bringing the sound to the listener, presumably in his home, (3) electronics for long time delays (10 to 100 milliseconds) to simulate the reflection path lengths, and (4) short time delays, (less than 1 millisecond) to simulate time delays associated with the spaced ears of the listener's head.

Referring to the embodiment of FIG. 2, the signals from right and left microphones $\mathbf{10}_r$, $\mathbf{10}_l$ placed in a pinna-less dummy head 12 are recorded on a two-track recorder 14 (or broadcast over a stereo FM station). On playback (or reception on an FM receiver) in the home, these two signals, *r* and *l*, represent the direct sound heard by the listener in the original hall. Thus, they only have to be modified by the pinna filters 18 to give the proper frequency response corresponding to 0 degrees azimuth, zero elevation. Appropriate filter response for pinna filters 18 and combination head shadow filter and pinna filter, 18, 28, are illustrated for a given pinna of a listener in FIGS. 2*a*–2*h* and are discussed below. In this embodiment the pinna responses for right and left ears differ. By such difference, the listener receives two distinctive pinna transformations of the signal, even when the signal comes from straight ahead, and these transformations are varied uniquely with angle of incidence in elevation and azimuth, in accordance with the characteristics of the pinna, thus providing a localization cue for the listener.

Because the direct sound of signals *r* and *l* are by definition to be uncorrupted by reflections, it is desirable to record the original sound with a minimum of echoes and reverberation. Thus, the dummy head with microphones is placed well forward in the recording hall. Also, drapes are employed to deaden the effects of the rest of the hall.

To represent the first reflection off the right wall, the reversed image $H_R$ of the stage off the right of the hall, FIG. 1, is created. This is accomplished by first delaying the right-stage sound by 20 msec. and the left-stage sound by 40 msec., by means of respective tapped delay lines 20. These signals are respectively attenuated in resistive attenuators 22 by an amount appropriate to the distance away from the image compared to the direct sound (1/R). Then each passes through a simple RC filter 24 designed to simulate the frequency-selective absorption characteristics of the right wall at the appropriate angle. For example, the high frequencies will scatter more off wall irregularities; thus the reflection will lose more high frequency energy than low, see typical curves FIG. 2*i*. This effect is simulated by the reflection filters 24. These three, longtime delays 20, 1/R attenuators 22, and reflection filters 24, in combination simulate one hall reflection.

To make the sounds representing this hall reflection appear to come from angles of say 35° to the right for the right-stage signal and 45° to the right for the left-stage signal (to reverse the image) each is fed to both the left and right ears, with proper interaural time delay corresponding to these angles, and via the head-shadow filter (for the shadowed ear only, in this case, the left ear), and via the pinna frequency response filters corresponding to these angles. For the given 1st right wall reflection these transforms are implemented by pinna filters 18 for the two ears and, for the shadowed ear, short time delay 26 and head shadow filter 28.

Referring to FIGS. 2 and 3–3*b* the resultant four signals are denoted by:

| | | |
|---|---|---|
| r | $I_R$ | for $E_r$ |
| r | $I_R$ | for $E_l$ |
| l | $I_R$ | for $E_r$ |
| l | $I_R$ | for $E_l$ |

where *r* and *l* denote right and left recorded stream, $I_R$ denotes 1st reflection right wall and $E_r$ and $E_l$ denote right and left ear. In similar fashion, $I_C$ and $I_B$ denote 1st reflection ceiling and back wall (see FIGS. 4–4*c*) respectively and $II_{LR}$ and $II_{RL}$ denote second reflection, left wall to right wall (see FIGS. 5*a* and 5*b*), and second reflection, right wall to left wall, respectively.

Each reflection to be simulated is treated in a way similar to that described above, with appropriate delays and responses as indicated in FIG. 2. Depending upon the effect desired, between 5 and 20 reflections may be simulated, including the first-order reflections off the side walls, the back wall, and the ceiling, and the dominant second-order reflections. The number of separate reflections to be simulated can be reduced by adding in a channel of "general reverberance" to each side, to represent sound that has undergone many reflections, and has lost all directionality. This may be implemented by reinserting a signal that has passed through the long delay back into the input of the delay in attenuated form.

Right and left summing circuits 30 serve to sum the respective direct and delayed versions of the sounds as shown in FIG. 2, and to apply these to respective earphones 32 (or loudspeakers or speaker assemblies placed close to the respective ears). These introduce the sound to the respective ears of the listener without substantial interaction of the actual pinna of the listener, and the listener depends only upon the signal with its various delayed attenuated and filtered components for achieving the realistic auditorium effect.

In constructing a simulator according to the embodiment of FIG. 2, the appropriate number of paths to be simulated will be determined by the engineer as a trade-off between the degree of realism to be obtained and the cost. Assuming a given path is chosen, the various parameters mentioned above can be readily determined. Thus the actual length of the path from sound source to listener in the hall being simulated can be measured, which sets the attenuating effect for the 1/R attenuator 22 as well as the tap point for delay 20. In FIG. 2 exemplary values are shown.

The absorption characteristics of the wall or ceiling surface involved, at the angle of the selected path, as is known, can be determined over the audible range of frequencies by measurement using known techniques. The respective RC reflection filter 24 is then constructed to produce this filter characteristic.

The interaural delay between the two ears is determined trigonometrically by the distance between the two ears along the given path, and the time it takes sound to traverse that distance. The interaural time delay will range between zero, for sound coming from front or back of the auditorium with equal path length to the two ears, to a maximum of 600 microseconds for sound coming from a side wall directly opposite one of the ears.

The head shadow and pinna effect response curves for the selected path can be determined by direct measurement by placing a small microphone in a subject's ear. Then the function of the pinna filter 18 and the head shadow filter 28 for a given sound path can be implemented in the form of a single filter circuit constructed to produce the respective response curve.

According to the invention it is realized not only that one person's pinnas are different from those of another person, but also a person's left pinna is physiologically somewhat different from his right pinna, so much so that its acoustical response is significantly different. The present inventor's acoustical research indicates that this difference between a listener's two ears, and the resultant different transforms they apply to the sound arriving at the ears provides a means by which humans can determine localization of the sound without previous knowledge of the nature of the sound to be heard.

In accordance with these findings, for most realistic simulation, the pinna response-head shadow response curves for the ears of a given listener are determined separately in advance by a series of measurements and these characteristics are either built into the circuitry, for an individualized device, or the pinna response filter portion of the device is made adaptive or adjustable to enable the matching of the response of the device to the pinna characteristics of the individual listener. In other circumstances, this feature may be compromised, as in the interest of cost, while still obtaining certain benefits, by establishing e.g. through measurement and averaging a pinna characteristic curve for use by an entire group of listeners.

For measurement of individual response, the following procedure may be employed: The subject is seated in an anechoic chamber, and a small speaker is mounted on a minimally reflecting boom such that it can be moved to almost any point on a hemisphere of radius 1.1 meter centered on the subjects's head. A small, high quality microphone (e.g. Thermo-Electron Model 526) is placed in the subjects's ear with the microphone diaphragm located approximately at the ear canal entrance. The oscillator signal from a Wave Analyzer (e.g. General Radio Model 1900) is fed through an amplifier to the speaker, and the microphone output is fed to a tracking filter and detector in the analyzer, and then to a chart recorder synchronized to the oscillator. With the subject's head restrained the sound source is then located at selected angles of elevation, and azimuth corresponding with the directions of the paths to be simulated at each such position the signal picked up by the microphone is analyzed and recorded. The curve of signal strength plotted against frequency thus represents a transform of the speaker signal attributable to the effects of head shadow (where present) and pinna response. FIGS. **2*a*–2*h*** are a set of such curves.

Thus one-time measurement, to be conducted for each ear of the listener, determines the particular pinna responses head shadow responses for his ears, and is implemented in hardware for a set of pinna filters dedicated to this listener's use or employed to set the response of the individual listener or an approximation thereof into programmable filters, as noted above.

Referring more particularly to FIGS. **2*a*–2*h*** this set of response curves is for a given subject's right ear taken with the speaker at 0° elevation (in the horizontal plane of the subject's ear) with selected angles of azimuth, where 0° is the direction faced by the subject, 90° is the position directly aligning the speaker with the ear containing the microphone and 270° is the position on the opposite side of the head.

It may be assumed that another such set of curves is produced for the left ear of the listener where the pinna disparity feature of the invention is employed. In instances where the same pinna is taken for both ears, the curves of FIGS. **2*a*–2*h*** may again be employed for the left ear, keeping in mind that azimuth for the left ear proceeds counter-clockwise from the 0° direction.

FILTER CHARACTERISTICS FOR RIGHT EAR ($E_r$)

Figures 2A, 2B, 2C, 2D:
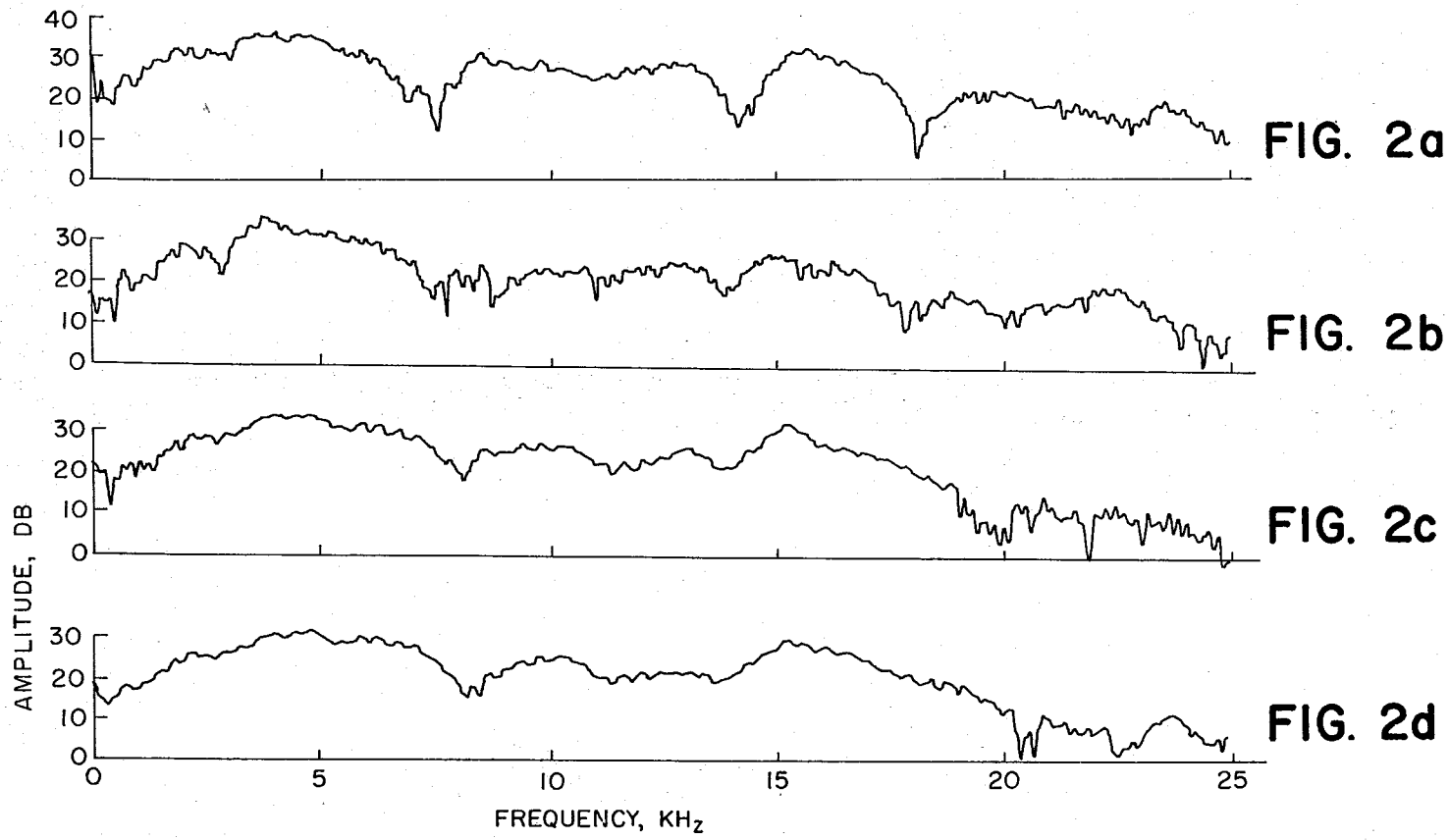
Figures 2E, 2F, 2G, 2H, 2I:
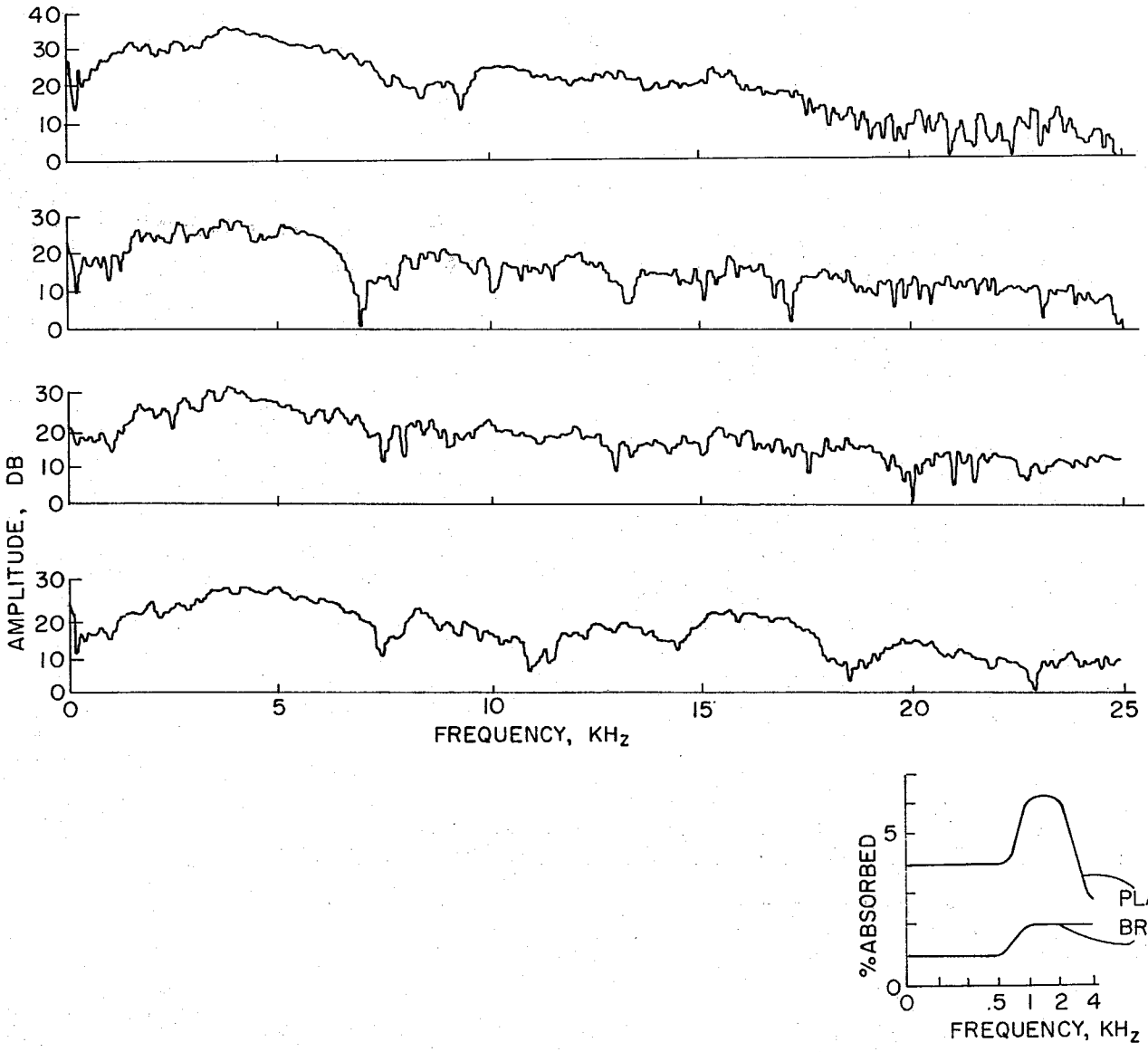

| Path | Azimuth | Pinna Filter 18 | Combined Pinna Filter 18 and Head Shadow Filter 28 |
|---|---|---|---|
| r | 0° | FIG. 2a | |
| $II_L$ | −35° | | FIG. 2h |
| $rI_R$ | +35° | FIG. 2b | |
| $rI_L$ | −45° | | FIG. 2g |
| $II_R$ | +45° | FIG. 2c | |
| $III_{LR}$ | +58° | FIG. 2d | |
| $rII_{RL}$ | −58° | | FIG. 2f |
| $III_{RL}$ | −63° | | FIG. 2f |
| $rII_{LR}$ | +63° | FIG. 2d | |

-continued

| FILTER CHARACTERISTICS FOR RIGHT EAR ($E_r$) | | | |
|---|---|---|---|
| Path | Azimuth | Pinna Filter 18 | Combined Pinna Filter 18 and Head Shadow Filter 28 |
| $rI_n$ | 180° | FIG. 2e | |

By appropriate mearurement the response for the ceiling reflection, $rI_c$ (0° azimuth, 45° elevation) can also be measured and implemented.

ADAPTER

FIG. 2 shows the sound recorded binaurally, with a dummy head and microphone spacing of about 6 inches. It is also possible to use the apparatus in FIG. 2 with standard stereo recording techniques, i.e. 20 foot microphone spacing D. For this purpose, referring to FIG. 6, an adapter 40 enables direct binaural sound to be simulated by adding to the direct sound signal recorded by one microphone, sound from the other channel as if it were received by the head 12 (see FIG. 6*a*) in a path from the other recording microphone, with appropriate delay and head shadow. This complete system could be used in conjunction with a standard stereo record or tape to simulate a concert hall performance, provided the original record or tape was recorded with minimum reverberation ("dry"), as is often the case.

In more detail the adapter comprises two short delay devices 42 defining a delay equal to the difference, for right ear $E_r$, between the time of receipt of sound from right microphone $10_r'$ and the receipt of sound from left microphone $10_l'$, and vice versa for left ear $E_l$. It also comprises two head shadow filters 28 with a filter characteristic appropriate for right ear $E_r$, to incidence at angle a of the sound from the left microphone upon the listener and for the left ear vice versa.

The series of delay 42 and head shadow filter 28 having an output to the left ear receives as input the direct signal $r'$ from the right microphone, and vice versa. The outputs of these circuits are added at summing points 44 to the direct signal, then applied to the respective pinna filters 18, thence to summing circuits 30 as in FIG. 2.

In another instance, where it is desired to simulate binaural listening in open space, as in playing in a country field, the earphones or close speakers may be fed only the combination signals provided by the adapter 40, without addition of simulated reflections. In this case, too, the listener can perceive directionality of the sound, rather than having the common sensation of the source of sound being located internally of his head.

Combining Two Reflections

Another embodiment of the invention is shown in FIG. 7. Here the simulation of reflection has been simplified by combining several of the functions indicated separately in FIG. 2. For certain halls, the reflection of sound off the walls will be relatively constant over much of the wall surface and some compromise of the pinna and head shadow effects may be introduced. In these cases it will not be necessary to have separate relfection filters for each reflection off that wall. For example, to represent the first reflection off of the right wall, the left and right signals are delayed and passed through the 1/R attenuators as before, but then are summed at 50, and passed through one reflection filter 52, as shown in FIG. 7. The figure also shows that this arrangement reduces by a factor of two the number of short-time delays, head shadow filters, and pinna filters. As a further embodiment along these lines the wall reflection filter 52 may be omitted for situations where the effect of absorption may be neglected, as where there is a trade off in favor of lower cost, or the absorption effect of the particular wall material being simulated is small or is substantially constant in effect over the frequency range of interest.

Small Stage

For recording sessions in which the performers occupy only a small part of the stage, or more accurately, where the performing group subtends only a small angle (20° or so) at the microphones, then in each reflection the performers can be approximated as a point source center stage. A system appropriate for such situations is shown in FIG. 8. The same general pattern of signal processing is followed as in FIG. 2, but here because it is not necessary to preserve the left and right sides of the stage in the reflected image, but only the center, no cross-connections are required.

Monaural Reflections

Considerable simplification of the hall reflection simulation, but not the head simulation, results if the reflections are processed monaurally rather than in two channels. Such a realization is shown in FIG. 9. The left and right signals as recorded are still fed binaurally to the ears to represent the direct sound. However, to simulate hall reflections, the left and right signals are added, and this sum is fed into one 100 msec delay. A number of 1/R attenuators and reflection filters are used to complete the hall simulation, then the processing for each ear as before, i.e. short time delay, head shadow filter and pinna filters, is used to represent the effects of the head.

Multiple Microphones

In certain recording situations it may be desirable to use more than two microphones to obtain satisfactory separation and coverage. This might be the case if the stage were particularly wide, and the angle subtended by the stage at the dummy head discussed above were very large, say greater than 120°. FIG. 10 shows a way of using multiple microphones with the proposed simulator. The signal from each microphone is sent to both tracks of the tape recorder to create a simulated binaural tape. This is accomplished by passing the microphone signal through appropriate delays and attenuators as detailed in FIG. 10, in a manner similar in principle to that discussed with reference to FIG. 6. The resulting pseudo-binaural signal is then processed by any of the methods described above, for example, by the processor in FIG. 2.

Head Motion

It is well known that head motion provides the listener with important cues about localization of sound in space. Also, it is well known that standard binaural recordings are not usually externalized by the listener. Rather, the sound appears to be coming from within his head. According to another feature of this invention, the direction-signifying transforms are modified in accordance with the head position of the listener. To accomplish this, the head motion of the listener is sensed by any standard method (say for example an accelerometer and associated circuitry). This motion information is then used to appropriately change the pinna filters 18 and/or the short time delay units 26. Specifically, if the listener's head moves by ten degrees to the left, then the two direct images (*l* and *r*) and all hall reflections must be shifted ten degrees to the right as received by the listener. Thus for example in the embodiment of FIG. 2 each pinna filter must be modified to correspond to an angle 10 degrees larger in azimuth than that shown in the diagram. A corresponding change of 30 $\mu$s must be made in all time delay units, 26, except that the 30 $\mu$s change must be added or subtracted depending on the quadrant that the hall relection is coming from. Corresponding small changes in head shadow 28 would also be made.

Referring to FIG. 18, an accelerometer 150 is secured to the head band of the earphones and generates signals representing head motion. These signals are fed to logic circuitry 152 which generates control signals 154 to change the responses of the pinna filters 18 and the head-related time delays 26. For example, if the listener's head turned by 10 degrees to the left the filter 18 for the path $rI_R$ for the right ear as indicated in FIG. 2 would have its characteristic changed from that shown in FIG. 2*b* to that shown in FIG. 2*c*. Similarly the time delay for the left ear, produced by delay 26, would be changed from 270 $\mu$s to 360 $\mu$s, and similarly throughout the system.

In a similar manner, head motion can also be included in the other embodiments discussed above, i.e., FIGS, 6, 7, 8, 9 and 10.

Representative Circuits

Electronic circuity used in the preferred embodiment is diagrammed in FIGS. 11 through 17.

Attenuator

A representative attenuator circuit such as the one used for 1/R attenuators 22, is shown in FIG. 11, consisting of a pair of input terminals 110, 112, a pair of output terminals 114, 116 and two resistors 118, 120 of resistance $R_1$ and $R_2$ respectively. The input terminals are connected across resistor 118 connected in series with resistor 120. Output terminal 116 is connected directly to input terminal 112 and output terminal 114 is connected to the common connection of resistors 118 and 120.

In operation a voltage Vin which is to be attenuated is applied between terminals 110 and 112. A resulting current I flows through resistors 118 and 120 of magnitude $$I = \frac{\text{Vin}}{R_1 + R_2}.$$

The voltage across resistor 120, which is the output voltage, is determined by the current flow through resistor 120 and is given by $$\text{Vout} = IR_2 = \frac{\text{Vin } R_2}{R_1 + R_2}.$$

By setting the values of $R_1$ and $R_2$, Vout can be adjusted to any value between Vin and zero and thus may be set to represent a known 1/R loss.

Filters

Figure 12:
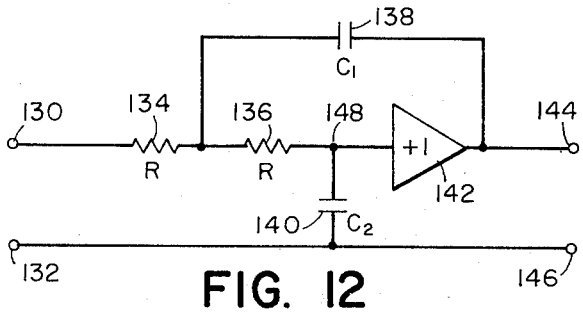
Figure 13:
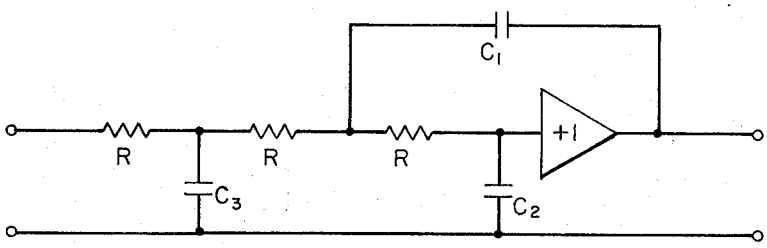
Figure 14:
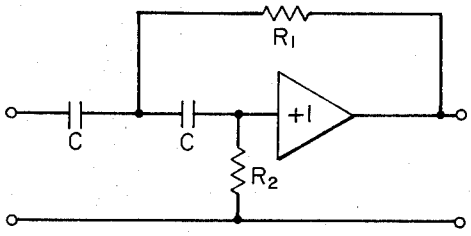
Figure 15:
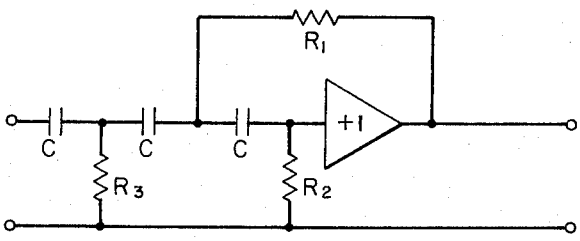

The filters used as head shadow and pinna filters 18, 28 are constructed as series and parallel combination of several basic building block filters shown in FIGS. 12 through 15. Each of the building block filters is an active filter, that is, an operational amplifier is included in its components. Since each of these circuits is well-known and since the analysis of all of them is similar, only the circuit of FIG. 12 will be described. FIG. 12 shows a representative two-pole low-pass filter. It includes input terminals 130, 132, two resistors 134, 136 of equal value R, two capacitors 138, 140 of values $C_1$ and $C_2$ respectively and an operational amplifier 142 with gain of one as well as output terminals 144, 146. Input terminal 132 and output terminal 146 are connected directly. Resistor 134 is connected to input terminal 130 on one end and to resistor 136 and capacitor 138 on the other. The second end of resistor 136 is connected to capacitor 140 and to the input terminal of operational amplifier 142. The second end of capacitor 140 is connected to input terminal 132. The second end of capacitor 138 is connected to the output terminal of operational amplifier 142 and to output terminal 144 of the filter.

In operation a signal is applied across input terminals 130, 132. In the absence of the feedback loop including capacitor 138, resistors 134 and 136 and capacitor 140 would form a voltage divider network which is dependent on frequency. The operational amplifier 142 draws no significant current into its input terminals but transfers the voltage at point 148 to the output terminal 144. The voltage at output terminal 144 is fed back through capacitor 138, with operational amplifier 142 providing the necessary current. This current adds energy to the network and at d-c voltage compensates for the inevitable losses due to current flowing through resistors 134, 136, which permits a loss-less response for d-c voltages. By appropriate choice of the values R, $C_1$ and $C_2$, the filter may be adjusted to have either a flat response with frequency, a sharp cut-off, a flat time-delay response or some optimum combination of these. Design of such filters, choice of the parameters and combination of them to achieve various response curves is discussed in the Aug. 18, 1969 issue of *Electronics.*

Short Time Delay Lines

The delay lines used for short-time delay lines 26 are of the "bucket-brigade" type. A representative section of a bucket-brigade delay line is shown schematically in FIG. 16. MOS transistors 152, 156, 162, and 166 are connected in series with the drain of each transistor connected to the source of the next transistor along the line. The gate of alternate transistors are connected to clock lines 160 or 170 respectively. The input terminal is 150 and the output terminal 180 for this section of delay line. A square wave at the clock frequency is applied to line 160 and a second square wave at the same frequency, but 180° out of phase with the first square wave is applied to line 170. The parasitic gate-drain capacitances 154, 158, 164, 168 are deliberately made large and serve as the storage units for each transistor, 152, 156, 162, 166 respectively.

In operation, a signal is applied to input terminal 150. At the same time the clock voltages are applied to lines 160 and 170. Each cycle of the clock samples the input signal. During one-half of a cycle, transistors 152 and 162 are turned on simultaneously and transistors 156 and 166 are turned off. The voltage at terminal 150 charges capacitor 154 through transistor 152. The voltage across capacitor 158, if any, charges capacitor 164 through transistor 162. During the next one-half cycle of the clock, transistors 152 and 162 are turned off and transistors 156 and 166 are turned on. The voltage on capacitors 154 and 164 now charge capacitors 158 and 160 through transistors 156 and 166 respectively. This cycle repeats and the voltage, originally at input terminal 150 progresses down the line until it reaches output terminal 180. The length of time needed for the signal to start at input terminal 150 and reach output terminal 180 is equal to the inverse of the clock frequency times one-half the number of transistors in the line. Delay lines can be constructed to produce variable delays by tapping the line of transistors at regular intervals. Additional detail may be found in *Electronics*, Feb. 28, 1972.

Long Time Delay Lines

Circuitry used for long-time delay lines 20 is shown in block diagram form in FIG. 17. The delay line is comprised of input terminals 190, 192, a sampling circuit 194, an analog-to-digital converter 196, a shift register 198 and several digital-to-analog converters 200 together with several output terminals 202–210 and a clock signal input terminal 212.

In operation a signal is applied between terminals 190 and 192. The first part of the clock signal into clock signal input terminal 212 activates the sampling circuit 194, a gate which allows the signal to be applied to the analog-to-digital converter 196 and the amplitude of the signal is converted into a digital word and is stored in shift register 198. The second part of the clock signal deactivates the sample circuit and moves each stored word in shift resister 198 one location from the input side to the output side. Then the cycle repeats itself. Stored signal amplitudes progress through the register at a rate determined by the clock frequency. Certain storage locations, corresponding to time delays desired by the user, are tapped and each time a new word enters those locations, the word is converted from digital to analog form and appears at that one of the output terminals 202–210 which corresponds to the time delay created by the progression of the signal from the input to that storage location. The technology of such time delay lines is well-known.

I claim:

1. For use with an auditorium simulator for sound performances having an input for the signal to be played and outputs for right and left transducers that are closely associated with the respective ears of the listener, listener simulating means comprising pinna response simulating circuitry having characteristics simulating differences between the left and right pinnas of a listener for modifying said signal and applying to said right and left transducers outputs in the form of different direction signifying transforms in accordance with the effect of the listener being disposed in the auditorium being simulated, the output of said pinna response simulating circuitry corresponding as a function of amplitude and frequency to the binaural pinna disparity auditory localization cue of the listener.

2. An auditorium simulator for producing separate signals for two signal-to-sound transducers to be used respectively with the right and left ears of a listener, comprising a source for a signal stream, right and left summing circuits each connected to the signal stream and to a plurality of additional inputs, and input to each summing circuit comprising a connection to the signal stream through reflection conditioning circuitry which introduces delay and attenuation representing the path effects of single reflection of the sound from a given left or right side wall of the auditorium to be simulated, a first of said summing circuits corresponding to the given side wall receiving its input through respective conditioning circuitry simulating for the input a given direct path from the sound source to the given wall, thence to the ear, and through first pinna response simulating circuitry that simulates pinna response of one ear of the listener as a function of frequency at the angle of incidence of said given path upon the listener, and the other summing circuit receiving its input through conditioning circuitry simulating a path like that of said first summing circuitry and including an additional attenuation and delay based upon the effect of the listener's head being interposed in the path of the reflected sound from the direction being simulated, and through second pinna response simulating circuitry that simulates pinna response of the other ear of the listener as a function of frequency at the angle of incidence of said given path upon the listener, said first and second pinna response simulating circuitries having different filter characteristics simulating differences between the right and left pinnas of a listener, the respective conditioning circuits and pinna response simulating circuitries altering the signals before reaching the respective transducers to impart realistic simulation of sound reception in an auditorium.

3. An auditorium simulator for producing separate signals for two signal-to-sound transducers to be used respectively with the right and left ears of a listener, comprising a source for right and left signal streams representing right and left sound streams produced by spaced apart pick-ups from a sound source, right and left summing circuits each connected to the respective signal stream and to a plurality of additional inputs, a pair of inputs to each summing circuit comprising connections respectively to the right and left signal streams through reflection conditioning circuitry which introduces delay and attenuation representing the path effects of single reflection of the sound from a given left or right side wall of the auditorium to be simulated, a first of said summing circuits corresponding to the given side wall receiving its pair of inputs through respective conditioning circuitry simulating for each input a path from the sound source to the given wall, then to the ear, the delays in the pair of inputs being different in an amount representing a difference in length of the sound paths, and the other summing circuit receiving its inputs through conditioning circuitry simulating paths like that of said first summing circuitry and including an additional attenuation and delay based upon the effect of the listener's head being interposed in the path of the reflected sound from the direction being simulated, the respective conditioning circuits altering the signals before reaching the respective listener's ears to impart realistic simulation of sound reflection from a given direction in an auditorium and a pinna simulator filter connected to each said summing circuit, each said pinna simulator filter being operable to attenuate the signals as a function of frequency over the range of 6–12 kilohertz in accordance with the different pinna responses of the left and right ears of the listener at the simulated angles of incidence of the simulated sound paths upon the listener.

4. The auditorium simulator of claim 3 in which said signal source comprises a two-channel stereo player for playing a recording of respective right and left signal streams.

5. An auditorium simulator for sound performances having an input for the signal to be played and outputs for right and left transducers that are closely associated with the respective ears of the listener, the simulator having a delay means for providing delayed versions of the signal for simulating the lengths of predetermined sound paths in an auditorium, the delays of said versions being between about 10 to 100 milliseconds, and listener simulating means comprising pinna effect filter means that establishes different filter characteristics for the respective transducers simulating differences between the right and left pinnas of a listener, the output of said pinna effect filter means corresponding as a function of the amplitude and frequency to the binaural pinna disparity auditory localization cue of the listener producing from said versions outputs for the left and right transducers in the form of different direction-signifying transforms in accordance with the effect of the listener being disposed in the respective sound paths being simulated.

6. The auditorium simulator of claim 5 wherein connections route a given version of said signal through listener simulating means associated with each of said outputs, the versions of said signals reaching said two outputs being different due to said differing direction-signifying transforms.

7. The auditorium simulator of claim 5 wherein the source of the sound in the auditorium to be simulated has substantial stage width and said sumulator is constructed to simulate an image of said source reflected from a selected side wall of the auditorium and wherein, for the ear which is on the isde of the head remote from the wall from which the sound is simulated to arrive, said listener simulating means comprises a delay means for introducing a delay of less than a millisecond, corresponding to the difference in distance of the two ears of the listener along the path being simulated, a head shadow filter and a pinna-effect filter, and wherein the listener simulating means for the ear nearer said wall comprises a pinna-effect filter.

8. The auditorium simulator of claim 5 wherein each of said delayed versions of the signal passes through an altering means comprising an attenuator for decreasing its energy on the basis of the length of its respective path, thence to a summing point, for summing with the remaining versions, thence to a reflection filter means for decreasing the energy of the summed signals on the basis of loss due to frequency-selective absorption at the reflecting surface, thence branching to each listener simulating means, thence to the respective transducer.

9. The auditorium simulator of claim 5 wherein the source of the sound in the auditorium to be simulated is a point source and said simulator is constructed to simulate an image of said source reflected from a selected side wall of the auditorium, the listener simulating means for each of the listener's ears receiving an equally delayed version of the signal from said source to represent said image.

10. The auditorium simulator of claim 5 and further including means for altering said delayed version in accordance with the respective sound path comprising an attenuator for decreasing the energy of the signal on the basis of the length of the simulated path and a reflection filter means for decreasing the energy of the signal on the basis of loss due to frequency-selective absorption at the reflecting surface.

11. The auditorium simulator of claim 5 wherein said delay means comprises a tapped delay line.

12. The auditorium simulator of claim 5 wherein for a given simulated path, said pinna-effect filter means simulate pinna response at the angle of incidence of said given path upon the listener.

13. The auditorium simulator of claim 12 including an adapter circuit for converting multiple stereo channels into two output signals that represent direct sound received by the right and left ears of a listener at the performance, said adapter comprising, for each output signal, a summing point for adding to the signal of one of said stereo channels a modified signal from an other stereo channel, and respective means comprising a time delay of less than 1 millisecond representing the time delay said listener would experience at said performance if the sound originated at the pickup point used in picking up signal for said other stereo channel, and a head shadow filter for decreasing the added signal in accordance with head shadow effect experienced by said listener at the performance under the conditions stated below.

14. The auditorium simulator of claim 13 wherein there are two of said stereo channels picked up with a microphone spacing on the order of 20 feet.

15. The auditorium simulator of claim 13 wherein there are more than two stereo channels, and a plurality of said channels are delayed, head shadow filtered and summed to provide a respective output signal.

* * * * *